United States Patent [19]

Epley

[11] Patent Number: 4,756,312

[45] Date of Patent: Jul. 12, 1988

[54] MAGNETIC ATTACHMENT DEVICE FOR INSERTION AND REMOVAL OF HEARING AID

[75] Inventor: John M. Epley, Portland, Oreg.

[73] Assignee: Advanced Hearing Technology, Inc., Portland, Oreg.

[21] Appl. No.: 920,145

[22] Filed: Oct. 16, 1986

Related U.S. Application Data

[63] Continuation-in-part of Ser. No. 592,236, Mar. 22, 1984, Pat. No. 4,628,907.

[51] Int. Cl.[4] ..... H04K 25/02

[52] U.S. Cl. ..... 128/420.5; 381/68.6; 128/1.6

[58] Field of Search ..... 128/1 R, 1.6, 420.5; 81/488; 381/68, 68.6; 335/285, 286, 295

[56] References Cited

U.S. PATENT DOCUMENTS

| | | | |
|---|---|---|---|
| 2,888,617 | 5/1959 | Barnet | 335/295 |
| 3,452,310 | 6/1969 | Israelson | 335/286 |
| 4,412,096 | 10/1983 | Edgerton et al. | 381/68.6 X |
| 4,565,904 | 1/1986 | Harada | 381/68.6 |
| 4,575,702 | 3/1986 | Nitta et al. | 335/286 |
| 4,584,437 | 4/1986 | Giannetti | 381/68.6 |

*Primary Examiner*—Edward M. Coven
*Attorney, Agent, or Firm*—Klarquist, Sparkman, Campbell, Leigh & Whinston

[57] ABSTRACT

A direct contact hearing aid apparatus adapted to be mounted deep within the ear canal is disclosed, including an output electromechanical transducer for converting audio output signals into mechanical movement of an output coupling element without the production of discernible sound waves to prevent acoustic feedback. The coupling element is supported for magnetic engagement with a contact element mounted on the tympanic membrane by a metal clip attached to the malleus bone to provide direct electromechanical coupling to the ossicles through the tympanic membrane. Alternatively, the contact element may be attached to the malleus bone by a clamp whose jaws are lined with bioactive ceramic. A pair of magnetic switches is provided within the hearing aid housing for mechanically switching the connections of the battery and a volume control while the hearing aid is mounted in the ear canal in response to changes in the polarity of a remote external magnetic actuator located outside of the housing. An external magnetic attachment device is used for insertion and removal of the hearing aid, radio or other electronic apparatus into and from the ear canal by magnetic engagement with a magnetic holder member on the electronic apparatus. The magnetic attachment device may be unipolar or bipolar and has a permanent magnet which is rotated between an attraction position and a release position by a selection knob. The output transducer of the hearing aid may be a piezoelectric plastic film transducer in the form of a flexible diaphragm or a folded sheet bender of the bimorph type, or it may be an electromagnetic transducer. The electromagnetic transducer may have an external magnetic coupling element mounted outside the hearing aid housing and spaced from the magnetic core of such transducer but coupled to the contact element. Also, a reverse bias permanent magnet may be provided at the end of such core to repel a movable permanent magnet which is mounted on a resilient coupling member to form the external magnetic coupling element.

10 Claims, 4 Drawing Sheets

INPUT TRANSDUCER
AMPLIFIER
ATTENUATOR
OUTPUT TRANSDUCER
BATTERY
VOLUME INCREASE
VOLUME DECREASE
+V
-V
N
S

MAGNETIC ATTACHMENT DEVICE FOR INSERTION AND REMOVAL OF HEARING AID

REFERENCE TO RELATED APPLICATION

The present application is a continuation-in-part and division of pending U.S. patent application, Ser. No. 592,236 filed Mar. 22, 1984, by John M. Epley, now U.S. Pat. No. 4,628,907.

BACKGROUND OF INVENTION

The subject matter of the present invention relates generally to hearing aid apparatus and in particular to direct contact hearing aid apparatus mounted in the ear canal with an output transducer having its output coupling element supported to provide direct electromechanical coupling to the ossicles through the tympanic membrane. The coupling element may engage a contact element mounted on the outer surface of the tympanic membrane, and such elements may be a magnet and a magnetic member to provide a magnetic connection. The invention also relates to hearing aid apparatus employing a piezoelectric plastic film as the output transducer. An external magnetic attachment device is employed for insertion and removal of the hearing aid, radio or other electronic apparatus into the ear canal by magnetic engagement with a holder member on the housing of such apparatus. Externally actuated magnetic switch means are provided within the housing for remote mechanical switching of the electrical connections of a battery and volume control means therein.

The present invention is especially useful as a direct contact hearing aid mounted deep within the ear canal of persons who wish to conceal such hearing aid from the view of others. However, such invention is also useful for other types of external hearing aids where it is advantageous to minimize acoustic feedback phenomena.

Conventional external hearing aids, in which the input transducer is a microphone and the output transducer is a loudspeaker which modulates an air column between such speaker and the tympanic membrane of the eardrum, have several disadvantages. These disadvantages include acoustic feedback from the loudspeaker to the microphone, inefficient operation resulting in greater power dissipation and frequent battery changes, and distortion of the acoustical output due to the necessarily small diameter of the speaker diaphragm. Previous attempts to overcome acoustical feedback in conventional external hearing aids have included providing an airtight seal in the ear canal in an attempt to acoustically isolate the output transducer loudspeaker deep within the ear canal from the input transducer microphone as shown in U.S. Pat. No. 3,061,689 of McCarrell, et al., issued Oct. 30, 1962. This has been only partially successful in allowing maximal gain without feedback. This also has the disadvantage that the airtight mold used as a seal produces an uncomfortable sensation of fullness and increases the perception of internal noises such as one's own voice. In addition, in the McCarrell patent an ear mold containing the microphone, the amplifier and the battery is positioned at the external portion of the ear so that a volume control for such amplifier may be adjusted manually while the hearing aid is in place in the ear. Unfortunately, this requires that the ear mold piece of the hearing aid be located at a position where it can easily be viewed by persons talking to the wearer, which is cosmetically objectionable.

Both electromagnetic transducers and piezoelectric transducers are employed as output transducers in McCarrell, but they are not placed in direct contact with the outer surface of the tympanic membrane in the manner of the present invention. Instead, his output transducers are employed as loudspeakers to produce a sound output by vibrating a plastic diaphragm. However, in one embodiment an iron slug is mounted by adhesive directly on the outer surface of the eardrum and spaced away from the electromagnetic transducer core by an air gap whose width would inadvertently vary depending upon the position of the transducer in the ear canal. The width of such air gap is critical to efficiency since the latter varies inversely with the third power of such width. The appropriate air gap width for maximum efficiency would therefore be very difficult to obtain by positioning the hearing aid in the ear canal and to maintain with any consistency. In addition, the static undirectional stress placed on the eardrum membrane by attraction of the magnetic slug toward the electromagnetic pole piece would stress the ossicular chain and tend to weaken and tear the tympanic membrane.

The hearing aid of the present invention eliminates these disadvantages by positioning the output coupling element of the output transducer in direct contact with the outer surface of the tympanic membrane or with a contact element secured to the outer surface of such membrane, thereby eliminating any airspace between the output transducer and the tympanic membrane. As a result, there is direct electromechanical coupling from the output coupling element of the transducer to the ossicle bones through the tympanic membrane without the generation of any discernible sound waves, thereby eliminating acoustic feedback, providing a much more efficient operation and reducing distortion. Also, the lack of undirectional static stress would decrease the risk of damage to the tympanic structures.

An experimental hearing aid in which a magnet was attached by glue to the outer surface of the tympanic membrane for movement of the magnet by an induced electromagnetic field produced by a coil on the exterior ear is described by Goode, et al., in "Audition via Electromagnetic Induction" published July 1973 in *Arch Otolaryngol,* Volume 98, pages 23–26. This hearing aid, by employing electromagnetic induction coupling for movement of a magnet attached to the tympanic membrane, is not practical because of the large amount of power required to overcome the inefficiency caused by the gap between the magnet and the coil. Such article also describes earlier unsuccessful experiments by Wilska who attached small pieces of iron on the tympanic membrane for vibration by a coil and superimposed constant magnetic field of a permanent magnet which are placed over the ear canal, but the strong magnetic attraction apparently stretched or tore the eardrum and caused severe discomfort and pain. Wilska apparently also attached a small electromagnetic coil to the tympanic membrane with similar results except that the coil temperature also caused burning and pain. Unlike the present hearing aid, there was no direct electromechanical coupling of the output transducer of the hearing aid into engagement with the outer surface of the tympanic membrane or with a contact element provided on such membrane with all of its advantages of excellent sound fidelity, low power requirements and no pain, stress or damage to the eardrum during operation of the hearing aid.

It is interesting to note that as recently as September 1982 researchers were still attempting to implant hearing aid output transducers, such as piezoelectric ceramic vibrators, in the middle ear in order to overcome the disadvantages of conventional external hearing aids. In this regard, see the summary of Japanese research and development projects in the article "Implantable Hearing Aid Project" published in *Jetro,* September 1982, pages 6 to 10, which discloses a similar hearing aid to that shown in one of the embodiments of the earlier discussed U.S. Pat. No. 3,712,962 of Epley.

It has been previously proposed in U.S. Pat. No. 3,832,580 of Yamamuro, et al., issued Aug. 27, 1974, and U.S. Pat. No. 4,369,391 of Micheron issued Jan. 18, 1983, to provide a piezoelectric plastic transducer in nonhearing aid devices, such as a phonographic pick-up and pressure sensing cables, made of a piezoelectric plastic film including a natural or synthetic high molecular weight polymers and polyvinylidene fluoride. However, such piezoelectric plastic film has not previous been used in a hearing aid. It has been discovered by the present inventor that the low mechanical impedance of piezoelectric plastic film transducers closely matches that of the middle ear conducting mechanism so that it is ideal for use as the output transducer of a hearing aid. This discovery has lead the inventor to develop several different types of piezoelectric plastic film output transducers for hearing aids which are shown herein.

It is advantageous in most situations using a contact hearing aid in accordance with the present invention to have an output transducer configuration with a low mechanical impedance, because when the transducer is directly coupled with the middle ear sound transmitting system, its mechanical impedance is incorporated into that of this system. If this increase in impedance is too great, it creates an increased perception of internal sounds such as the person's own voice or chewing. This annoying effect can be minimized by using an output transducer in which the active element has high compliance and low mass. Several output transducers embodying these principles were described in my pending U.S. patent application Ser. No. 592,236, filed Mar. 22, 1984. Several further embodiments are described herein.

Bias permanent magnets have been used in electromagnetic transducer applications where they provide several advantages. They allow the use, as the active element, of a permanent magnet with a highly compliant mounting, such as a diaphragm, in conjunction with an electromagnetic coil containing a ferromagnetic core. Such ferromagnetic core greatly increases the efficiency of the coil. Wihout the insertion of a reverse bias magnet between the active magnet and the core, the magnetic field induced in the core by the active magnet would create a static force acting upon the active magnet in the direction of the core, thereby placing a static strain on the resilient mounting and decreasing its compliance. Also, this static force would greatly limit the allowable narrowness of the gap between the active magnet and the core, and such gap narrowness of the mounting is critical to the efficiency of the transducer. As the gap provided by the mounting is made smaller, the static force of the attraction will increase exponentially. Since the counterforce of the elastic mounting follows a direct arithmetic function, a point will be reached at which this counterforce will be overcome by the induced magnetic force which follows an exponential function, and the active magnet will be forced into contact with the core and will be unable to vibrate. This problem can be overcome by inserting a reverse bias magnet as a permanent magnet oriented with its polarity in the reverse direction to that of the active permanent magnet, between the active magnet and the ferromagnetic core. To limit the range of this repulsion and to create a neutral mounting point for the active magnet with a relatively narrow gap, a stronger but more distant forward bias magnet is mounted opposite the reverse bias magnet. At this neutral mounting point, there will be no static force acting upon the active magnet and, thus, maximum compliance of the elastic mounting.

Although the physical mass of the bias magnets themselves may limit the proximity of the active magnet to the ferromagnetic core, if the bias magnets are made of high permeability material they will transmit the variations in magnetic flux induced by the electromagnetic coil with an efficiency approaching that of the ferromagnetic core, so that the effective gap is essentially that existing between the active magnet and the reverse bias magnet.

To minimize the possibility that the clip arms attaching the contact element to the handle of the malleus may cause erosion of the underlying bone in contact with said arms, bioactive ceramic material such as hydroxyl apatite can be utilized in the construction of such attachment using a metal clamp with jaws lined with said bioactive material. When said bioactive material comes into contact with living bone, a slight dissolution takes place at the bone-implant interface, forming a double layer transition film of silica gel and calcium phosphate through an exchange of sodium and hydrogen ions, which crystalizes to bond the bone to the implant. In the present application, the bioactive material will act to prevent bony erosion due to static pressure or vibration at the interface between the implanted clamp jaws and the malleus. In addition, it will act to prevent instability of the mounting.

SUMMARY OF INVENTION

It is therefore one object of the present invention to provide an improved hearing aid apparatus for mounting in the ear canal so that the output transducer thereof has its output coupling element in contact with the tympanic membrane or a contact element on the exterior surface of the tympanic membrane to provide direct electromechanical coupling to the ossicles through the tympanic membrane for more efficient operation and for concealment from the observer.

Another object of the invention is to provide such a hearing aid in which the output transducer does not produce discernible sound waves, but provides mechanical coupling between the coupling element of the output transducer and the ossicles to eliminate acoustical feedback and to provide less distortion of the resulting acoustical output signal for more realistic hearing.

A further object of the invention is to provide such a hearing aid in which the contact element includes a magnetic member which is fastened by a clip or clamp to the malleus bone through the tympanic membrane and is held by magnetic attraction into contact with the output coupling element of the output transducer for better mechanical connection without stress or damage to the tympanic membrane and for more efficient operation.

An additional object of the invention is to provide such an improved hearing aid in which the output transducer is made of piezoelectric plastic film that provides the electromechanical vibration of the coupling element and has a vibration impedance which more nearly matches that of the ossicular chain of the middle ear for more efficient operation.

Still another object of the invention is to provide such a hearing aid apparatus which may be inserted into and removed from the ear canal more easily by an external magnetic attachment device with a permanent magnet which moves between an attraction position for magnetic attachment to a holder member on the hearing aid housing, and a release position for releasing such holder member.

A further object of the invention is to provide a magnetic attachment device for inserting or removing a hearing aid, radio or other electronic apparatus within the ear canal using unipolar or bipolar magnetic attraction for firm attachment to a holder member on such apparatus.

A still further object of the invention is to provide such a hearing aid in which magnetic switches are employed in the housing of the hearing aid to change the connections of a battery in such housing to turn on and off an amplifier therein and to adjust a volume control of the hearing aid by means of an external magnetic device while the hearing aid is mounted within the ear canal.

A still additional object of the invention is to provide an improved hearing aid having an output transducer of electromagnetic or piezoelectric type provided with a counterpoise means that may include a counterweight and which moves in an opposite direction to the output transducer to reduce internal vibration.

A further object of the invention is to provide a hearing aid in which the mechanical coupling element of the output transducer is mounted in a highly resilient manner and with minimal inertial loading to avoid increasing the internal impedance of the middle ear sound conduction mechanism to an extent which would increase the user's perception of internal noise.

A still further object of the present invention is to provide such a hearing aid in which the elimination of acoustical feedback and the provision for remote control of power and volume allows the entire hearing aid apparatus to be placed deep within the ear canal for concealment from the observer.

DESCRIPTION OF DRAWINGS

Other objects and advantages of the present invention will be apparent from the following detailed description of several preferred embodiments thereof and from the attached drawings of which.

DESCRIPTION OF PREFERRED EMBODIMENTS

Figures 1, 2, 3, 4, 5:
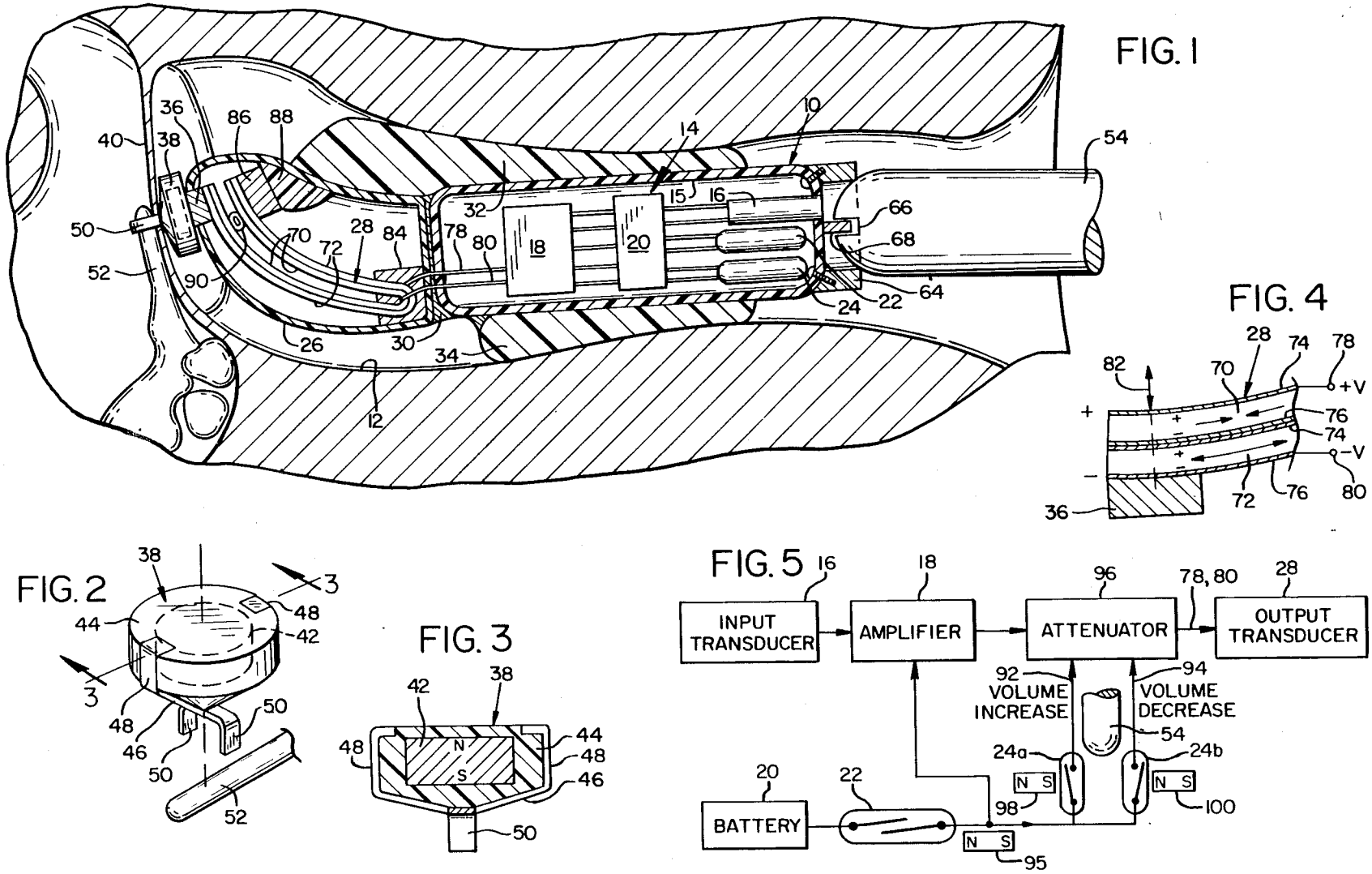
FIG. 1 is a cross-section view of a hearing aid in accordance with one embodiment of the present invention shown mounted within the ear canal so that its output transducer coupling element is in engagement with a contact element mounted on the exterior of the tympanic membrane and attached to the malleus bone, together with a portion of a magnetic inserter for such hearing aid.
FIG. 2 is an enlarged perspective view of the contact element of FIG. 1 placed on the outer surface of the tympanic membrane before it is attached to the malleus bone.
FIG. 3 is a section view taken along the line 3—3 of FIG. 2.
FIG. 4 is an enlarged partial section view of a portion of the piezoelectric plastic film output transducer employed in the hearing aid of FIG. 1.
FIG. 5 is a block diagram of the electrical circuit of the hearing aid of FIG. 1 showing magnetically actuated switches for controlling the volume and for connecting the battery to the hearing aid in response to an external magnetic actuator.

As shown in FIG. 1, a hearing aid apparatus 10 in accordance with one embodiment of the present invention is adapted to be mounted within the ear canal 12 so that it cannot be seen by a casual observer. The hearing aid 10 includes a main electrical circuit portion 14 contained within a main housing 15. The main circuit 14 includes a microphone input transducer 16, an amplifier 18 and a battery 20. The amplifier includes a digital attenuator volume control that may be of the type shown in my earlier U.S. Pat. No. 4,020,298 of Epley, et al., issued Apr. 26, 1977, and both can be formed on a single integrated circuit chip as a solid state amplifier and digital attenuator. In addition, the main circuit 14 also includes a pair of magnetic switch means 22 and 24 which, respectively, function as an on/off switch for the battery and as a volume control switch for adjusting the amplitude of the output signal of the hearing aid, in a manner hereafter discussed.

An output housing 26 is attached to the main housing and contains an output transducer 28 electrically connected to the output of the amplifier 18. The output housing 26 may be made of flexible plastic material suitably secured to the main housing 15 of more rigid plastic material by a suitable adhesive 30. A pair of cushions 32 and 34 of polyurethane foam or other resilient elastomer material are also secured to the outer surface of the main housing 15 in any suitable manner, such as by gluing. However, it is also possible to make the main housing 15 solid rather than hollow, so that the main circuit components are embedded in soft plastic and the cushions 32 and 34 are formed integral therewith. The cushion members 32 and 34, which may be custom molded to the shape of the wearer's ear, engage the surfaces of the ear canal 12 to hold the hearing aid snugly within the ear canal in a position so that an output coupling element 36 attached to the output transducer 28 is in engagement with a contact element 38 mounted on the outer surface of the tympanic membrane 40. Alternatively, the output coupling element 36 may be placed in direct contact with the outer surface of the tympanic membrane.

The contact element 38 is shown in greater detail in FIGS. 2 and 3 and includes a magnetic insert 42 which may be a cylinder 42 of magnetic material, such as a permanent magnet, embedded in a cylindrical button 44 of suitable plastic material having a conical bottom surface which engages the outer surface of the tympanic membrane 40. The button 44 is mounted on a clip 46 of platinum, tantalum or other inert material. The clip 46 includes a pair of holder arms 48 which engage notches in the opposite sides of the button 44 to hold the contact element 38 and a pair of mounting legs 50 which are bent around the end of the malleus bone 52 after passing through the tympanic membrane to mount such contact element on the outer surface of such membrane. Thus, mechanical movement of the coupling element 36 by the output transducer 28 in response to the output signal of the hearing aid is directly coupled to the contact element 38 and through the tympanic membrane 40 to the malleus bone 52 of the ossicular chain in the preferred embodiment of the present invention. However, it is also possible to attach the contact element 38 by adhesive to the outer surface of the tympanic membrane 40 or to engage such membrane directly with the output coupling element 36. The output coupling element 36 is a cylindrical or rectangular block of ferromagnetic material, such as soft iron, which is attached to the output transducer 38 in any suitable manner such as by adhesive. This output coupling element is magnetically attracted by the permanent magnet insert 42 into engagement with the contact element 38 when the hearing aid apparatus 10 is mounted within the ear canal 12 in the operating position shown in FIG. 1.

Figure 17:
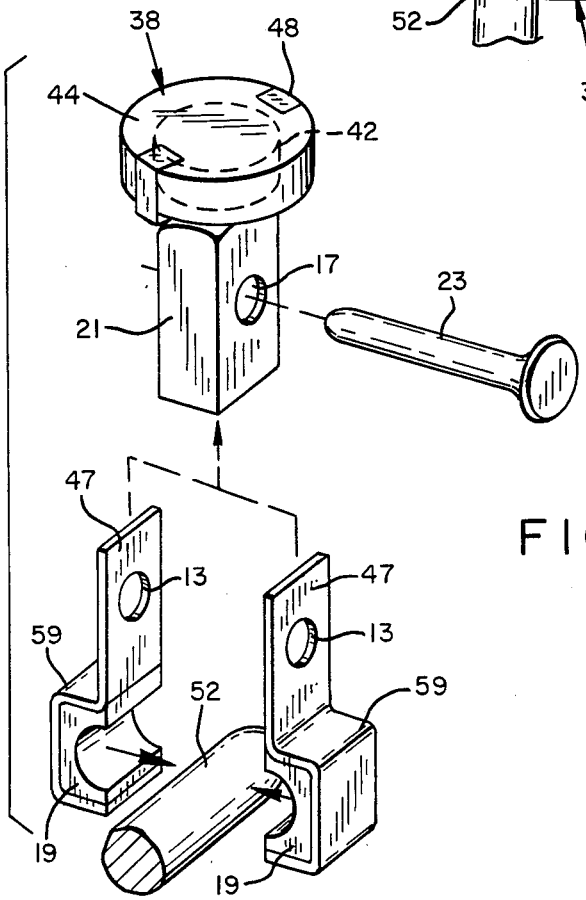
FIG. 17 is a perspective view of another embodiment of the contact element, which in this case attaches to the malleus bone via a pair of clamp jaws lined with bioactive ceramic material.

Another embodiment of the contact element is shown in FIG. 17. A pair of metal clamp jaws 59 are lined with bioactive ceramic material 19 at the concave surface where contact with the malleus will occur. Each clamp jaw 59 extends to a clamp handle 47 which is penetrated by a fenestration or opening 13. After the clamp jaws 59 are surgically mounted on each side of the malleus and the two clamp handles 47 brought into apposition, a metal cover 21 having fenestrations 17 is slipped over said clamp handles. A retainer pin 23 is inserted through the fenestrations 17 in the cover and through the fenestrations 13 in the clamp handles contained therein and bent at the point, thus maintaining said jaws tightly around said malleus. Attached at the top of cover 21 is a cylindrical button 44 which acts as the contact with the output coupling element 36. This embodiment provides greater stability and less tendency to erode the malleus.

Figure 6:
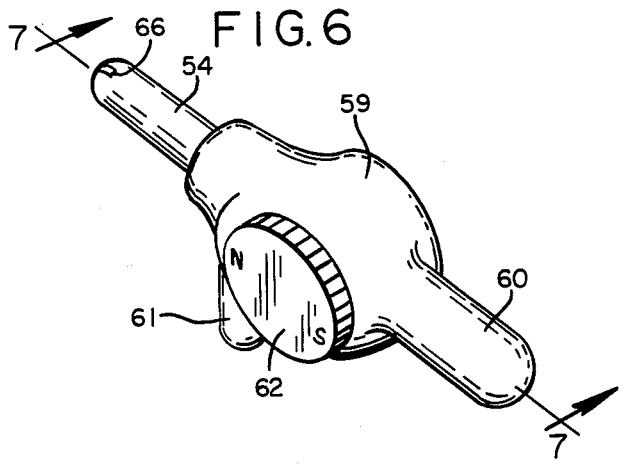
FIG. 6 is a perspective view of a first embodiment of a magnetic device which uses controllable unipolar magnetism for insertion and removal of the hearing aid apparatus of FIG. 1 into and out of the ear canal, which is also used as a magnetic actuator for actuation of the switches of FIG. 5.
Figure 7:
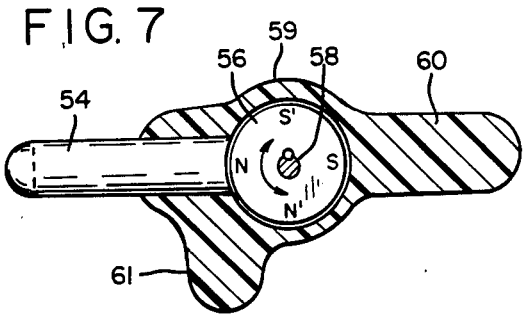
FIG. 7 is a section view taken along the line 7—7 of FIG. 6 showing the rotatable permanent magnet member within the inserter.

Insertion and removal of the hearing aid apparatus is accomplished by a magnetic attachment device, one embodiment of which includes a probe rod 54 which is shown in greater detail in FIGS. 6 and 7. The magnetic inserter probe 54 is a rod of ferromagnetic material which is mounted in contact with a rotatable permanent magnet 56 in the shape of a cylinder with its central axis perpendicular to its magnetic polar axis, that rotates about the axis of rotation of a mounting pin 58 keyed to such magnet to hold the magnet within a molded plastic housing 59. The housing of the inserter has a handle portion 60 and a stop portion 61 which engages the outer ear to limit the depth of penetration of the rod 50 within the ear canal. The magnet 56 is rotated by an adjustment dial 62 fixed to pin 58 in order to orient the north pole (N) or south pole (S) or intermediate position of the magnet 56 into contact with the end of the inserter rod 54 at different times. As a result, the polarity of the magnetic attraction at the outer end of such rod may be selected, and the magnet 56 may be moved to a neutral "release" position. The outer end of rod 54 is placed in engagement with a magnetic holder ring 64 of soft iron or other ferromagnetic material for magnetic attachment to enable insertion and removal of the hearing aid. The holder ring 64 is secured to the upper end of the main hearing aid housing 14 by rivets, screws, epoxy resin adhesive or any other suitable fastening technique. An orientation slot 66 may be provided in the end of the inserter rod 54 for engagement with an orientation bar 68 extending across the diameter of the holder ring 64 as shown in FIG. 1. This orientation means is necessary in order to orient the hearing aid apparatus in a proper rotational position of the rod 54 so that the output coupling element 36 is aligned with the contact element 38 during insertion of the hearing aid into the ear canal.

After insertion is completed, the knob 62 is rotated 90 degrees from the initial position N and S of its magnetic poles as shown in FIG. 7 to a neutral "release" position. This eliminates the magnetic attraction of the insertion probe rod 54 to release such rod from the holder ring 64 and thereby enables withdrawal of the inserter from the ear canal while leaving the knob of the hearing aid located in the position shown in FIG. 1. Withdrawal of the hearing aid apparatus from the ear canal is accomplished by maintaining the magnet 56 in the release position and then inserting the probe 54 until its slot 66 engages the orientation bar 68 and the probe moves down into contact with the magnetic holder ring 64. Then the magnet is rotated to the attraction position and the inserter 54 is withdrawn from the ear canal while it is magnetically attached to the hearing aid, thereby pulling the hearing aid from the canal. It should be noted that the orientation of the magnetic polarity of the inserter 54 is such that it opposes the magnetic polarity of the insert magnet 42 of the contact element 38, thereby inducing a magnetic field of reverse polarity in the coupling element 36 and releasing said coupling element from such contact element. Thus, with the magnetic insert 42 having the north/south polarity indicated in FIG. 3, for connection release and removal a north pole is provided at the slotted end 66 of the inserter probe 54.

The output transducer 28 is preferably made of piezoelectric plastic film and may be a bimorph piezoelectric transducer formed of two layers 70 and 72 of piezoelectric plastic film, such as a polyvinylidene fluoride (PVDF) manufactured by Pennwalt Corporation and sold under their tradename KYNAR. Each of the two piezoelectric film layers 70 and 72 is provided with a pair of metalized surfaces forming upper and lower contacts 74 and 76 on opposite sides thereof. The piezoelectric layers 70 and 72 are oriented so that the major axis of contraction and expansion of each are parallel to the other, but the electrical poling axis of one is oriented relative to the other so that one layer contracts as the other expands and vice versa as shown in FIG. 4. Thus, when a positive voltage (+V) is applied to the upper contact 74 of piezoelectric layer 70 and a negative voltage (−V) is applied to the lower contact 76 of layer 72, current flows downward through such layers causing the upper layer 70 to contract as indicated by the two arrows pointing toward each other and the lower layer 72 to expand as indicated by the two arrows pointing away from each other. This simultaneous contraction of layer 70 and expansion of layer 72 causes the bimorph transducer 28 to bend upward, thereby mechanically deflecting the coupling element 36 of ferromagnetic material which is secured to the end of the transducer as shown in FIG. 4. Of course, when the polarity of the output signal changes so a negative voltage is applied to contact 74 and positive voltage applied to contact 76 of layers 70 and 72, respectively, the direction of current flow through such layers reverses and the transducer bends downward. Output leads 78 and 80 attached to the outputs of the amplifier 18 are electrically connected to the contact layers 74 and 76 of the two piezoelectric layers 70 and 72, respectively, in order to cause bending movement of the output transducer and the coupling element 36 attached thereto toward and away from contact element 38 in the direction of arrows 82.

The output transducer 28 may be a sheet of bimorph piezoelectric film which is folded in the center to form a bender transducer with two spaced arms and is fixedly secured to housing 26 at its central portion by a suitable plastic material, such as epoxy resin, to provide a fixed anchor base 84 which is attached to the top end of the output housing 26. The amplifier output leads 78 and 80 are soldered to contacts 74 and 76 and embedded in the plastic anchor base 84 to prevent movement of such leads. The resulting piezoelectric bender transducer has its upper arm attached to a counterpoise weight 86 of lead or other suitable metal secured thereto by adhesive for movement with such upper arm as a counterpoise in a direction opposite to that of the coupling element 36 attached to the lower arm of such bender element. The counterpoise weight 86 is also resiliently secured to the output housing 26 by a resilient plastic foam 88 such as polyurethane for dampening purposes. Thus, the upper arm of the piezoelectric bender and its weight 86 together with the resilient foam mounting 88 reduce internal vibrations when the lower arm of the bender and the coupling element 36 attached thereto are moved in response to the receipt of an output signal on leads 78 and 80 from the hearing aid amplifier 18. A resilient spacer 90 which may be made of hollow tubing of rubber or other elastomer may be positioned between the two arms of the bender transducer 28 in order to further dampen the vibration of such arms and to maintain the proper spacing between such arms.

It should be noted that the coupling element 36 extends through an aperture in the output housing 26 into engagement with the upper surface of the contact element 38 in alignment with the insert magnet 42. Thus, moisture could enter the output housing 26 but will have no effect on the operation of the hearing aid because all exposed electrical connections are within the main housing 15 which is sealed. The input end of microphone 16 may extend through an aperture in the main housing 14 of the hearing aid to better receive sound wave signals transmitted through the ear canal, but its electrical connections are not exposed. Also, it is possible that the output transducer 28 of FIG. 1 will work if the upper arm and counterweight 86 attached thereto are eliminated. However, this is not desirable because of their counterpoise function which reduces vibration.

The electrical circuit for the hearing aid 10 is shown in FIG. 5 and includes a magnetic microswitch 22 connected between the D.C. power supply battery 20 and the amplifier 18 so that such battery is not connected to the amplifier until such switch is closed. This is accomplished by an external magnetic actuator which can be provided by the magnetic inserter of Figs. 6 and 7. Thus, the magnetic microswitch 22 may be a latching type of reed switch with a bias magnet 95 that is biased open and is closed only when an external magnetic field of sufficient strength is applied thereto and remains closed until again magnetically actuated, like a push button type switch. Another suitable magnetic switch is shown in U.S. Pat. No. 3,950,719 of Maxwell issued Apr. 13, 1976. When the north or south pole of the magnet cylinder 56 is in engagement with the probe rod 54 and such probe rod is moved near the holder ring 64, switch 22 is actuated. The output terminal of switch 22 is also connected through a pair of volume control switches 24A and 24B which may be magnetic reed switches that are more sensitive than switch 22 to an external magnetic field and have their movable contacts normally biased open and connected in common to the same input terminal. However, the fixed contacts of the magnetic switches 24A and 24B are connected to different control terminals 92 and 94 of a digital attenuator circuit 96 of the type shown in FIG. 3B of my U.S. Pat. No. 4,020,298 of Epley issued Apr. 26, 1977. Thus, when switch 24A is closed connecting control terminal 94 to the battery 20, the attenuator resistance decreases slowly so there is a volume increase and when switch 24B is closed to connect control terminal 94 to such battery, the attenuator resistance increases slowly so there is a volume decrease. The magnetic switches 24A and 24B are selectively actuated one at a time by changing the magnetic polarity of the actuator rod 54 between north and south. This is accomplished by providing a first bias magnet 98 adjacent the reed switch 24A whose inner end is of an opposite polarity to the inner end of a second bias magnet 100 positioned adjacent the reed switch 24B. Thus, in the position shown of the bias magnets 98 and 100, such bias magnets normally bias the magnetic switches 24A and 24B, respectively, to attract their movable contacts outward into the open positions shown. When the magnetic actuator probe 54 is positioned adjacent the switches 24A and 24B on the opposite sides of the switches from the bias magnets, a north magnetic pole on such probe will close switch 24B and leave switch 24A open, while a south pole on such probe will close switch 24A and leave switch 24B open. The magnetic polarity of the actuator probe 54 is changed from north to south by rotation of the magnet cylinder 56 through 180 degrees. In this manner, the magnetic switches 24A and 24B may be selectively actuated by moving the actuator rod 54 toward holder ring 64 for applying an external magnetic field to close one of the switches which is less than the field strength required to operate switch 22. It is obvious that the switches 22, 24A and 24B may be actuated by any external magnetic actuator, not merely that shown.

As shown in FIGS. 8 to 12 a second type of the magnetic attachment device 200 provides bipolar magnetic attachment which is stronger than the unipolar attachment of the first embodiment of FIGS. 6 and 7. This second attachment device includes a pair of curved stator plates 202 and 204 of ferromagnetic material having tapered extensions 203 and 205, respectively, at the outer ends thereof, which are positioned in spaced relationship on opposite sides of a permanent magnet 206. The magnet 206 is of cylindrical shape and is magnetized across its diameter. The magnet is mounted to be rotated 90 degrees in the direction of arrow 207 between an attraction position and a release position about the axis of a shaft 208 connecting such magnet to a selection means including a knob 210.

Figure 9:
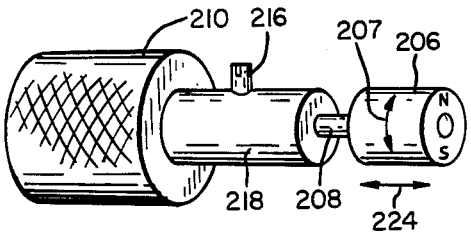
FIG. 9 is a perspective view of the magnetic device of FIG. 8 with the magnetic stator plates and the cam housing removed.
Figure 8:
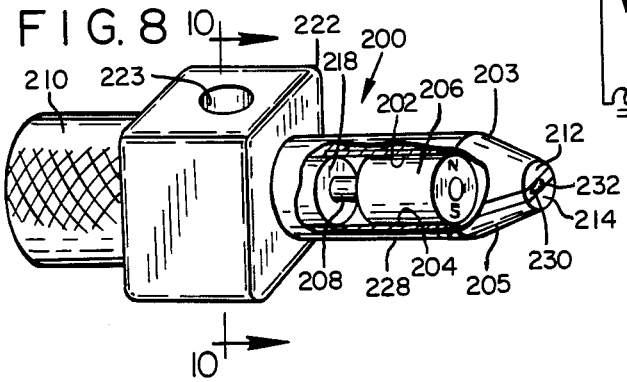
FIG. 8 is a perspective view of a second embodiment of the magnetic attachment device which uses controllable bipolar magnetism for insertion and removal of the hearing aid.
Figure 10:
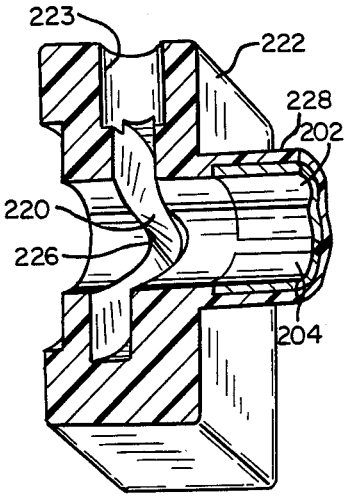
FIG. 10 is an enlarged horizontal section taken along the line 10—10 of FIG. 8 showing the cam groove on the cam housing.
Figure 11:
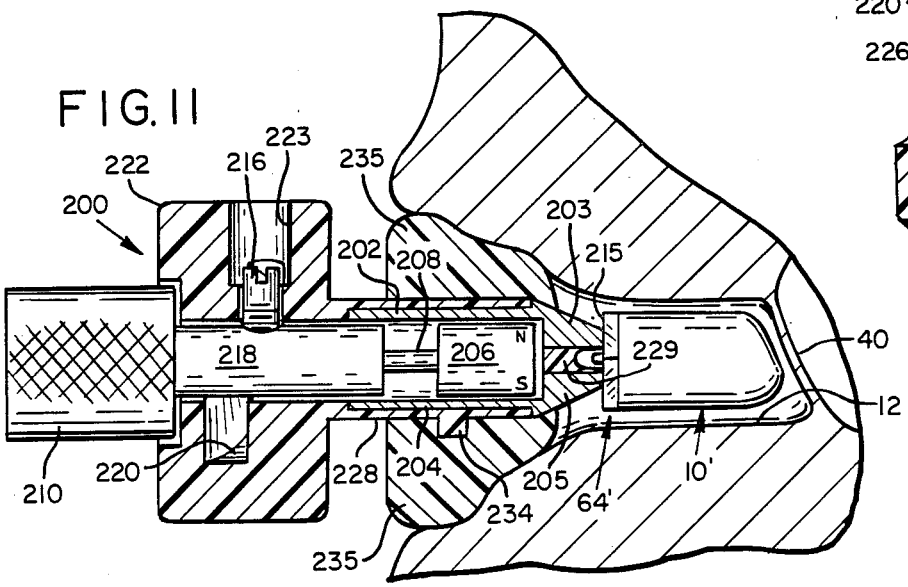
FIG. 11 is a side elevation view with parts broken away for clarity, of the magnetic attachment device of FIGS. 8 to 10 shown inserted into the ear canal in contact with the hearing aid.

In the attraction position of the magnet 206, which is shown in FIGS. 8 and 9, the north pole (N) of the magnet closely proximates the upper stator plate 202 to induce a magnetic field of north polarity at the flat tip 212 of the extension 203 of such stator plate. Similarly the south pole (S) of the magnet closely proximates the lower stator plate 204 and induces a magnetic field of south polarity at the flat tip 214 of the extension 205 of such stator plate. As shown in FIG. 11 when the flat tips 212 and 214 of the stator plates contact the flat plate portion 215 of the holder member 64' on the hearing aid, a magnetic circuit is completed between the north pole of tip 212 and the south pole of tip 212 through the ferromagnetic metal of the holder member in the attraction position of magnet 206. Thus, in such attraction position the magnetic attachment device 200 is strongly attached to the holder member 64' with a bipolar magnetic field, and may be used to insert and remove the hearing aid within the ear canal. When the knob 210 is rotated 90 degrees from the attraction position to a release position so that the north and south poles of the magnet 206 are directed at the gap between the stator plates 202 and 204, this eliminates the magnetic field at the tips so that they are released from attachment to the holder member 64' and the magnetic attachment device 200 can be withdrawn from the ear canal while the hearing aid remains therein.

A cam means is provided for detent orientation of the magnet 206, in either the attraction or release position. A cam follower 216 is mounted by screw threads on the side of a support cylinder 218 connected on the axis of the shaft 208 and between the magnet and the knob 210 so that such support cylinder and cam follower rotate with the magnet 206. A cam groove 220 is provided on the inner cylindrical surface of a fixed cam housing 222 which also serves as the handle of the magnetic attachment device 200. The cam housing is provided with a side opening 223 through which the cam follower 216 can be removed for disassembly. The support cylinder 218 extends to and is attached to knob 210. The cam follower is positioned within the cam groove 220. Since the cam housing is fixed, movement of the cam follower 216 along the cam groove 220 in response to rotation of the knob 210 causes the support cylinder 218 and the magnet 206 to move longitudinally in the direction of arrow 224. The cam groove 220 has four acute angles extending toward the tip which act as detents tending to maintain the rotor magnet 206 in either the attraction or release positions. The cam follower 216 tends to recess toward the detents because of the magnetic attraction longitudinally toward the tip of the stator plates 202 and 204 of the rotor magnet 206. It should be noted that the tapered shape of the end portions 203 and 205 of the stator plates 202 and 204 confines the magnetic flux to a small area of contact at tips 212 and 214, thereby decreasing the possibility of a deleterious effect on components of the electrical circuits.

Figure 12:
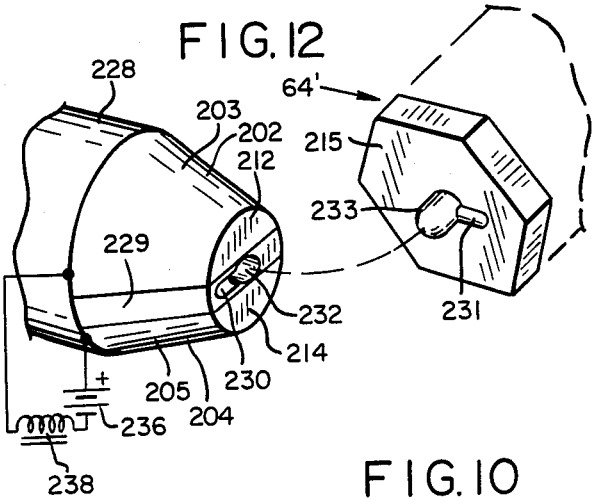
FIG. 12 is an exploded elevation view of a portion of FIG. 11 showing the tips of the stator plates in engagement with the mounting member on the hearing aid.

An outer casing 228 of nonmagnetic material is molded over the stator plates 202 and 204 so as to cover the magnet 206 and the shaft 208 as shown in FIG. 11. The casing 228 is attached to the cam housing 222 such as by molding the casing integral with the housing. The tapered stator portions 203 and 205 extend out of the casing 228 and are spaced apart by an insulating layer 229 of nonmagnetic material which separates the tips 212 and 214 for engagement with the holder member 64', as shown in FIG. 12. An orientation slot 230 at the tip surface is of a slightly greater dimension than an orientation projection 231 on the holder member 64'. The orientation projection 231 may be a rectangular bar extending across the surface of the holder member 64'. The orientation slot 230 serves a similar function to the orientation slot 66 in the probe 54 of the first magnetic attachment device of FIGS. 1 and 6. Thus, the orientation slot 230 and the orientation projection 68 of FIG. 12 enable the hearing aid apparatus to be oriented by the person installing such aid into the proper rotational position. Obviously, the slot and projection could be reversed so that the slot is on the tip of the probe. A guide opening 232 of circular shape is provided in the center of the space between the stator tips 212 and 214 through the spacer layer 229 to a greater depth than the slot 230. A guide projection 233 of circular shape is provided on the holder member 64' adjacent to orientation projection 231, but extends a greater distance above the flat plate portion 215 of such holder member. The guide projection 233 is of slightly less diameter than guide opening 232 so that it slides into such opening and guides the stator tips 212 and 214 into contact with the flat plate 215.

A mold retainer peg 234 is molded on the outer surface of the casing 228 in order to prevent movement of the magnetic attachment device 200 relative to an ear mold 235 of silicone rubber or other resilient plastic. The ear mold 235 is custom molded to the shape of the ear canal of the wearer while the magnetic attachment device 200 is properly positioned to engage the holder member 64' of the hearing aid in its operable position within the ear canal. Thus, the casing 228 and mold 235 provide a mounting means for mounting the magnetic attachment device 200 so that the stator plates extend into the ear canal sufficiently to engage the holder member 64' when the hearing aid is operably positioned within the ear canal with the coupling element 36 of its output transducer 28 engaging the contact element 38. In this operable position, the knob 210 can be rotated between the attraction position and the release position by a person grasping the housing 222 for a handle.

An electronic indicator means, such as a buzzer, is provided for indicating when there is magnetic attachment by the device 200 with the holder member 64'. This can be accomplished in the manner shown in FIG. 8 by connecting one terminal of a small D.C. voltage battery 236 to stator plate 204 and the other terminal of such battery to stator plate 202 through a buzzer winding 238. Thus, an electrical series circuit including the battery and the buzzer winding is completed whenever the tips 212 and 214 are connected together by contact with the ferromagnetic metal of the holder member 64'. The resulting buzzing noise indicates when magnetic attachment has been made. Of course, the battery and the indicator buzzer can be mounted with the housing 222. Also, a small D.C. electric motor can be employed to rotate the magnet 206, in which case the motor could be provided within the housing 222 with the support cylinder 218 forming the rotor of such motor.

Figure 13:
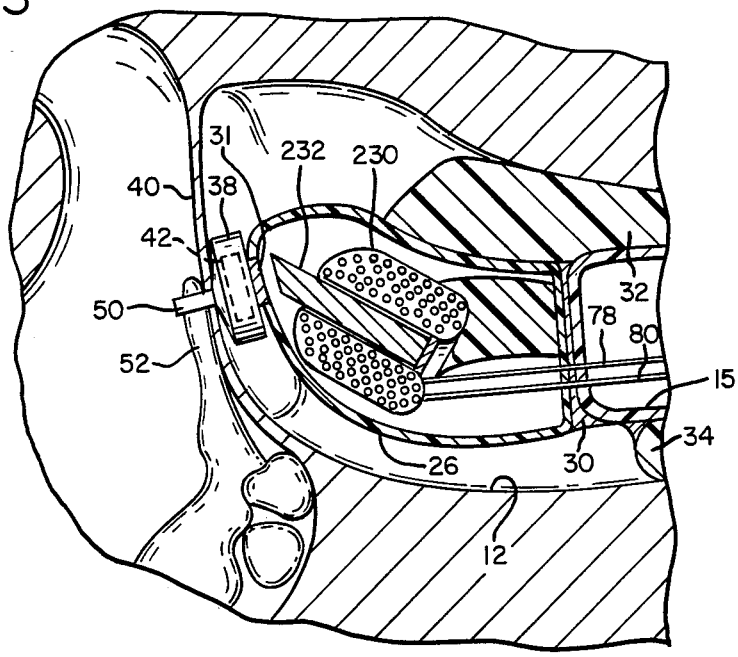
FIG. 13 is an enlarged cross-section view of another embodiment of the present invention in which the active component of the electromagnetic output transducer is the permanent magnet which is an integral part of the contact element described in FIG. 2.

Another embodiment of the contact hearing aid apparatus shown in FIG. 13 employs an electromagnetic output transducer configuration in which the active component is a movable, permanent magnet 42 which is an integral part of the contact element 38 described in FIG. 2. The stationary component is an electromagnet comprising an electromagnetic coil 230, surrounding a ferromagnetic core 232, connected by leads 78 and 80 to the outputs of the amplifier and fixed to the main housing 15. When the system is functionally engaged, the resilient coupling member 31 attached to the output housing 26 is maintained in contact with the contact element 38 which contains the permanent magnet 42 and is attached to the malleus or tympanic membrane.

As a result of the magnetic field changes produced by the electromagnetic coil 230 in the core 232, in response to the output signals applied to the leads 78 and 80, the permanent magnet 42 is deflected toward and away from said core and the output of the contact hearing aid is thus transmitted through the contact element 38 to the tympanic structures. The resilient member 31 on the output housing 26, by virtue of its contact with the contact element 38, acts to maintain the appropriate separation between the core 232 and the permanent magnet 42, as well as to stabilize said contact element so that the static attraction existing between said core and said permanent magnet, due to the magnetic field induced in said core by said magnet, is prevented from producing a static lateral strain on said contact element and the tympanic structures, as would be the case if an air gap existed between said contact element and the coupling element 38. Such static lateral strain on said contact element, if allowed to occur, would tend to retract said contact away from the malleus and tympanic membrane and could cause damage over time to these structures.

The resilient member 31, which provides separation between the core 232 and the permanent magnet 42, and stabilizes the contact element 38 relative to said core, could obviously be attached to said contact element instead of to the contact housing 26 of the hearing aid device. Such resilient separation member could be constructed of soft silicone, or could be a plastic diaphragm.

Figure 14:
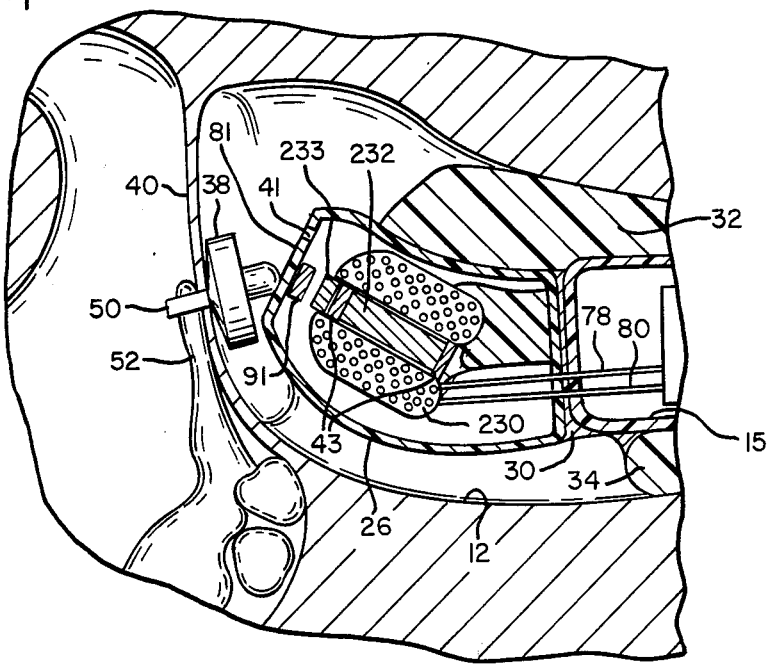
FIG. 14 is an enlarged cross-section view of yet another embodiment of the present invention in which the electromagnetic output transducer comprises a fixed electromagnetic driving a movable permanent magnet mounted on a diaphragm which is in apposition with the contact element attached to the malleus.

Yet another embodiment of the contact hearing aid apparatus, shown in FIG. 14, employs an electromagnetic output transducer configuration in which the stationary component is an electromagnet comprising an electromagnetic coil 230, surrounding a ferromagnetic core 232, connected by leads 78 and 80 to the outputs of the amplifier and fixed to the main housing 15. The active component is a permanent magnet 91 bonded by adhesive to a diaphragm 81 which is attached to the output housing 26. The diaphragm 81 has one or more openings or vents 41.

Figure 15:
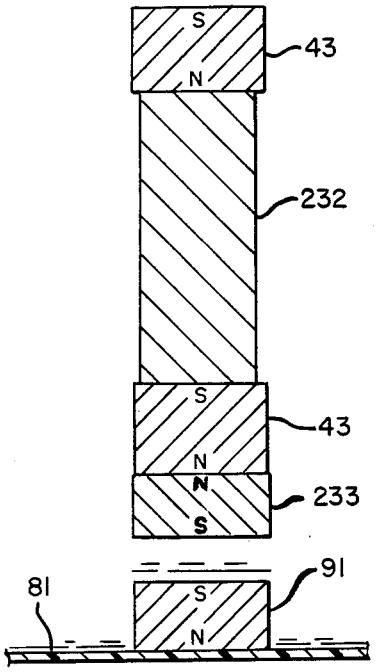
FIG. 15 is a diagrammatic cross-section illustrating the relationship of the ferromagnetic core, active magnet, diaphragm, and bias magnets used in the electromagnetic transducer illustrated in FIG. 14, and demonstrating the polarity orientation of the various permanent magnets.

The orientation of the various permanent magnets in the hearing aid of FIG. 14 is illustrated diagrammatically in FIG. 15. Attached to the front end of the ferromagnetic core 232 by a suitable glue is a reverse bias magnet 233, which is a permanent magnet with its polarity oriented so as to repel the active magnet 91. This configuration allows the active magnet 91 mounted on the diaphragm 81 to be used in close proximity to said ferromagnetic core and thereby prevent its being forced against said ferromagnetic core by induced static magnetic attraction or by external pressure against the diaphragm 81 by the contact element 38. At each end of said ferromagnetic core are forward bias magnets 43 which are permanent magnets with their polarity oriented so as to limit the repulsion of the active magnet 91 by the reverse bias magnet 233 to a narrow gap. Of the two forward bias magnets illustrated, only the one proximal to the reverse bias magnet 233 is essential to accomplish this function.

As a result of the magnetic field changes produced by the electromagnetic coil 230 in the core 232, in response to the output signals applied to the leads 78 and 80, the permanent active magnet 91 is deflected toward and away from said core and the output of the contact hearing aid is thus transmitted through the diaphragm to the contact element 38 and thus to the tympanic structures.

This output transducer configuration provides minimal inertial and elastic impedance to the sound conducting tympanic structures, and is applicable for ears with retention of low frequency thresholds in which increased mechanical impedance of said structures will cause annoying perception of internal body noise. The bias magnets 233, 43 tend to maintain the diaphragm in a neutral, compliant position so as to minimize elasticity, and the increased inertial load to the system due to the output transducer is limited to the small mass of the contact element 38 and the active magnet 91. Thus, although said bias magnets are not essential to the operation of this transducer configuration, their use will provide these advantages.

A diaphragm or other membrane operably in apposition with a tympanic contact element can be vibrationally driven by other transducer means to accomplish similar ends and still remain within the scope of the novel invention described. For the contact hearing aid of FIG. 14, the diaphragm is vented by openings 41 to minimize the production of acoustic output and thereby prevent acoustic feedback. The same configuration can be utilized for the output transducer for a noncontact hearing aid by eliminating said contact element and said vent in said diaphragm.

Figure 16:
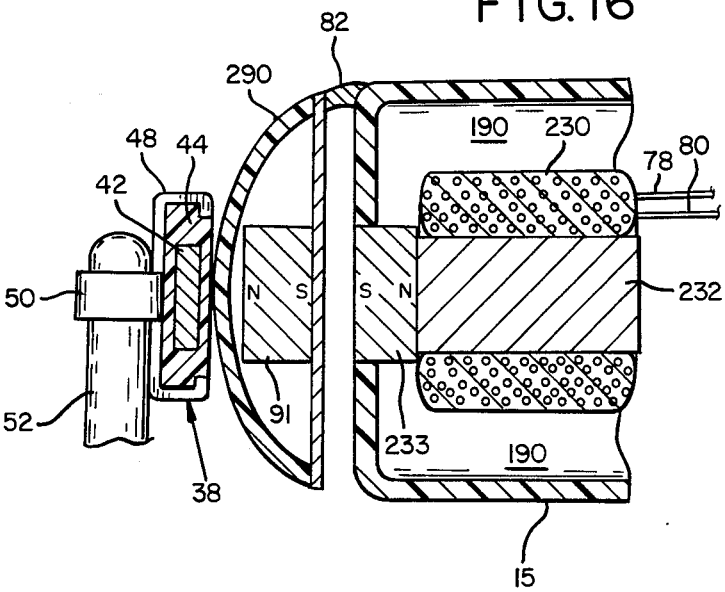
FIG. 16 is a cross-sectional view of another embodiment of contact hearing aid in which the active magnet and coupling element are exteriorized from, but resiliently attached to, the housing of the hearing aid.

Yet another embodiment of contact hearing aid is illustrated in FIG. 16, in which the output transducer follows the same electromagnetic configuration as that in FIG. 14, except that the active magnet 91 and the coupling element 290 are exteriorized from the housing 15 of the hearing aid. Also, the active magnet and coupling element are resiliently mounted on housing 15 via three small hinges 82 made of compliant material such as thin plastic sheet, and a small air gap is maintained between said coupling element and such housing via the repulsion force acting between active magnet 91 and the reverse bias magnet 233. As with the embodiment in FIG. 14, the magnetic field changes produced by the electromagnetic coil 230 in the core 232, in response to the output signals applied to the leads 78 and 80, cause the permanent magnet 42 in the hearing aid of FIG. 16 to be deflected toward and away from such core, and the output of the contact hearing aid is thus transmitted through the contact element 38 to the tympanic structures. As a result of the magnetic field changes produced by the electromagnetic coil 230 in the core 232, in response to the output signals applied to the leads 78 and 80, the permanent magnet 42 is deflected toward and away from said core and the output of the contact hearing aid is thus transmitted through the contact element 44 to the tympanic structures. A small ferromagnetic cylinder 42 may be inserted in the cylindrical button 44 of said contact element to maintain positive operational contact between said contact element and the coupling element 290, which is made of soft plastic material to minimize contact noise during insertion. A unipolar type of magnetic remover such as that illustrated in FIG. 6 is used in the removal process to induce a magnetic field in said ferromagnetic cylinder which repels the active magnet 91 in the coupling element 90.

It will be obvious to those having ordinary skill in the art that many changes may be made in the above-described preferred embodiments of the present invention. For example, the magnetic attachment device can be used to insert and remove electronic devices other than a hearing aid within the ear canal. Thus, the hearing aid shown in FIG. 1 can be replaced by a radio receiver or the earphone of an inductively coupled electronic "prompting" device used by musicians, public speakers, actors, and the like. Also, other types of hearing aids can be used instead of the direct coupled hearing aid of FIG. 1. Therefore, the scope of the present invention should only be determined by the following claims.

I claim:

1. A magnetic hearing aid attachment device adapted for insertion into a person's ear canal to insert or remove a hearing aid, radio or other electronic apparatus having a magnetic holder member within said ear canal, said magnetic device comprising:

magnetic attachment means for attachment to the magnetic holder member on said hearing aid or other electronic apparatus by magnetic attraction when said attachment means is actuated, and for releasing said holder member when said attachment means is deactuated;

selection means, including a permanent magnet, for selectively actuating and deactuating said magnetic attachment means by movement of the permanent magnet between an attraction position where it attracts said holder member and a release position where it releases said holder member; and mounting means for mounting said magnetic attachment means and said selection means on a support of said magnetic device so that said attachment means projects from the support sufficiently to enable attachment to said holder member when said hearing aid or other electronic apparatus is operably positioned with said ear canal, and said selection means is positioned on the support so as to be sufficiently accessible to be manually adjusted from said attraction position to said release position when the magnetic attachment means is so extended into the ear canal.

2. A device in accordance with claim 1 which also includes orientation means for orienting said magnetic attachment means relative to said hearing aid so that the hearing aid or other electronic apparatus is properly positioned within said ear canal.

3. A device in accordance with claim 2 in which the orientation means includes an orientation slot provided in said magnetic attachment means which engages an orientation projection on said holder member.

4. A device in accordance with claim 1 in which the selection means includes rotation means for rotating said magnet between said attraction position and said release position.

5. A device in accordance with claim 1 in combination with a hearing aid apparatus having an output transducer with a magnetic coupling element, and in which the magnetic attachment means also causes the coupling element of the output transducer in the hearing aid apparatus to be magnetically attracted into engagement with and released from engagement with a magnetic contact element mounted on the outer surface of the tympanic membrane when said selection means is moved to said release position and to said attraction position.

6. A device in accordance with claim 1 in which the mounting means includes a housing having a handle portion and the selection means includes a knob for movement of said magnet, and which includes an electrical indicator means for indicating when said magnetic attachment means engages said holder member.

7. A device in accordance with claim 1 in which the magnetic attachment means includes a pair of spaced stator plates of magnetic material with the permanent magnet positioned between said stator plates.

8. A device in accordance with claim 7 in which each of said pair of stator plates tapers down to a tip of reduced width at one end thereof and the permanent magnet is positioned relative to said stator plates to cause their tips to be of opposite magnetic polarity in the attraction position for bipolar attachment to the holder member on the hearing aid.

9. A device in accordance with claim 8 in which the selection means rotates said magnet between said attraction position and said release position.

10. A device in accordance with claim 9 which also includes detent means for keeping said magnet in either said attraction position or said release position.

* * * * *